US005526950A

United States Patent [19]

Tago et al.

[11] Patent Number: 5,526,950

[45] Date of Patent: Jun. 18, 1996

[54] ETCHING PROCESS, COLOR SELECTING MECHANISM AND METHOD OF MANUFACTURING THE SAME

[75] Inventors: Koichi Tago, Kanagawa; Shinzo Takei, Tokyo; Sumito Shina, Kanagawa, all of Japan

[73] Assignee: Sony Corporation, Tokyo, Japan

[21] Appl. No.: 299,968

[22] Filed: Sep. 2, 1994

[30] Foreign Application Priority Data

Sep. 7, 1993 [JP] Japan ..... 5-246250
Feb. 12, 1994 [JP] Japan ..... 6-013937

[51] Int. Cl.[6] ..... B44C 1/22; C23F 1/02

[52] U.S. Cl. ..... 216/12; 216/41; 216/56

[58] Field of Search ..... 156/644.1, 651.1, 156/656.1, 659.11, 661.11; 216/11, 12, 41, 43, 56

[56] References Cited

U.S. PATENT DOCUMENTS

| | | | |
|---|---|---|---|
| 3,179,543 | 4/1965 | Marcelis | 216/56 |
| 3,329,541 | 7/1967 | Mears | 216/56 |
| 3,679,500 | 7/1972 | Kubo et al. | 216/56 |
| 3,929,532 | 12/1975 | Kuzminski | 216/12 |

FOREIGN PATENT DOCUMENTS

0042496A1 12/1991 European Pat. Off. .

0521721A3 1/1993 European Pat. Off. .

OTHER PUBLICATIONS

Patent Abstracts of Japan, vol. 004, No. 011 (E-168), 26 Jan. 1980 & JP-A-54 152960 (Mitsubishi Electric Corp.) 1 Dec. 1979.

*Primary Examiner*—William Powell
*Attorney, Agent, or Firm*—Hill, Steadman & Simpson

[57] ABSTRACT

An etching process is disclosed which is suited for manufacturing color selecting mechanisms in wide scope of specifications without need of complicated process of manufacture.

The etching process comprises the steps of (a) forming an etching resist layer (20) on the front surface (10A) of a work (10) and also forming a protective layer (12) on the back surface (10B), (b) patterning the etching resist layer (12) to form a first opening (22) and a second opening (24) smaller than and near the first opening, and (c) etching the work to form a slit zone (32) under the first opening (22) and a recess (34) under the second opening (24) while removing at least a portion (10C) of the work spacing apart the slit zone (32) and the recess (34), thereby forming an electron beam passage slit (30) having a greater opening area defined on the side of the front surface (10A) by the slit zone (32) and the recess (34). (See FIG. 3 )

10 Claims, 15 Drawing Sheets

ELECTRON BEAM INCIDENCE SIDE

ELECTRON BEAM EMISSION SIDE

ETCHING PROCESS, COLOR SELECTING MECHANISM AND METHOD OF MANUFACTURING THE SAME

BACKGROUND OF THE INVENTION

1. Field of the Invention

This invention relates to an etching process, a color selecting mechanism for a color cathode-ray tube and a method of manufacturing the same. The invention is applicable to, for instance, the color selecting mechanism for a color television receiver picture tube.

2. Description of Related Art

The color picture tube usually has a color selecting mechanism which faces the color phosphor screen. The color phosphor screen provides color when predetermined color phosphors are illuminated by electron beams corresponding to individual colors R, G and B sorted by the color selecting mechanism.

As the color picture tube color selecting mechanism, various structures have been proposed. For example, a "Trinitron" (a registered trade name) color picture tube uses an aperture grill type color selecting mechanism assembly 100, as shown in the perspective view of FIG. 11, which is disposed such that it faces a color phosphor screen 200. The aperture grill type color selecting mechanism assembly 100 comprises a a thin metal sheet 110 with a number of parallel slits 130 formed therein such that electron beams pass through these slits.

The color phosphor screen 200 comprises vertical color stripes (not shown) of red, green and blue colors which are arranged parallel in a predetermined sequence. The color selecting mechanism assembly 100 is disposed such that it faces the color phosphor screen 200. The thin metal plate 110 has many electron beam passage slits 130 extending in the direction of the phosphor stripes at least from the upper edge to the lower edge of the effective screen area.

Specifically, the thin metal sheet 110 of the aperture grill type color selecting mechanism assembly 100, is made from a high purity steel sheet which is 0.08 to 0.15 mm thick and has a number of parallel electron beam passage slits 130. The thin metal sheet 110 is stretched over a frame 140.

The frame 140 comprises, for instance, a pair of, i.e., an upper and a lower, frame portions 140A and 140B and a pair of arm portions 140C and 140D connecting the frame portions 140A and 140B to each other. The front end surfaces of the frame portions 140A and 140B are curved surfaces forming the same cylindrical surface. As shown in FIG. 1, the thin metal sheet 110 is stretched on the front end surfaces of the frame portions 140A and 1408.

The thin metal sheet 110 is mounted in the frame 140 by using turnbuckles (not shown) for pulling the frame portions 140A and 1408 of the frame 140 toward each other. In this state, edges of the thin metal sheet 110 are welded to the front end surfaces of frame portions 140A and 140B. Then, the turnbuckles are removed to release external forces applied to the frame 140. Thus, by the restoring force of the frame 140 the thin metal sheet 110 is stretched with a predetermined tension generated in the direction of the slits 130.

As a method of forming the electron beam passage slits 130 in the thin metal sheet 110, the following technique is well known in the art.

FIGS. 12A to 12C illustrate a prior art method of manufacturing an aperture grill type color selecting mechanism.

The method is suited for manufacturing a color selecting mechanism, with electron beam passage slits arranged at a comparatively coarse pitch, and it is commonly called a single-step double-side etching process.

(Step 10A)

In this single-step double-side etching process, a photosensitive etching resist is coated on both the front and back surfaces of thin metal sheet 110 for forming electron beam passage slits therein. The thin metal sheet 110 is made of iron or a metal composition mainly composed or iron. Subsequently, a first and a second photosensitive etching resist layer 120 and 122 formed on the front and back surfaces, respectively, of the thin metal sheet 110 are patterned. For the sake of brevity, hereinafter the surface of the thin metal sheet 110 formed with the first photosensitive etching resist layer 120 may sometimes be referred to as front surface, and the surface of the thin metal sheet 110 formed with the second photosensitive etching resist layer 122 as back surface.

For the patterning of the first and second resist layers 120 and 122, a pair of photosensitive etching resist masks with respective patterns are used for the front and back surfaces. The pair resist masks have to be positioned stringently. The first and second resist layers 120 and 122 are patterned in a usual method comprising successive steps of exposure, development, drying and hardening. As a result, a pattern with slit-like openings having a width $w_1'$ are formed in the first resist layer 120, and a pattern with slit-like openings having a width $w_2'$ in the second resist layer 122 (see FIG. 12A). The openings in the resist layers 120 and 122 are formed such that the center line of each opening in the first layer 120 is aligned to or stringently parallel to the center line of the corresponding opening in the second layer 122.

(Step 20A)

Then, with the first and second photosensitive etching resist layers 120 and 122 with the slit-like openings with the widths $W_1'$ and $W_2'$ as etching masks, the thin metal film 110 is wet etched simultaneously from both the front and back surfaces by using, for instance, an aqueous solution of mercuric chloride. The etching of the thin metal sheet 110 proceeds through the openings with the widths $w_1'$ and $w_2'$, and eventually electron beam passage slits 130 penetrating the thin metal sheet 110 are formed (see FIG. 12B).

(Step 30A)

Subsequently, the first and second photosensitive etching resist layers 120 and 122 are removed from the surfaces of the thin metal sheet 110. In this way, a color selecting mechanism comprising the thin metal sheet 110, which has a structure as shown schematically in the fragmentary sectional view of FIG. 12C, can be obtained.

The width of the slits 30 on the electron beam incidence side (corresponding to the back surface of the thin metal sheet 110) is defined by the width $w_1'$ of the openings formed in the second resist layer 122, while the width of the slits 130 on the electron beam emission side (corresponding to the front surface of the thin metal sheet 110) is defined by the width $w_2'$ of the openings formed in the first resist layer 120.

The reason for forming the electron beam passage slits 130 having the sectional profile as described above, will now be described with reference to fragmentary sectional views of FIGS. 13A to 13C showing the thin metal sheet 110. Each electron beam passes through each electron beam passage slit 130 from the electron gun side of the thin metal sheet 110 to the phosphor screen side. The angle of electron beam incidence with respect to the color selecting mechanism is changed in dependence on the position of the electron beam incidence on the color selecting mechanism. If the side walls of the slits 130 are the nearer the vertical, the more the electron beam incident on each slit 130 is subject to reflection by the side walls of the slit 130, as shown in FIG. 13C. When such an electron beam arrives at the phosphor screen, picture tube characteristic reduction results from the reflection of the electron beam (or halation).

On the other hand, with the electron beam passage slits 130 having the sectional profile as shown in FIG. 13A or 113B, the electron beam incident on each slit 130 is less subject to reflection by the side walls of the slit 130. Thus, it is possible to effectively prevent the reflection of electron beam (or halation). For the above reason, usually the area of the slits 130 of the thin metal sheet 110 on the phosphor screen side is made greater than the area of the slits on the electron gun side.

The single-step double-side etching process has a problem that it is difficult to obtain stringent mutual positioning of the front and back surface resist masks. In addition, it is difficult to adequately control the conditions of etching of the then metal sheet 110 from the front and back surfaces thereof. Therefore, it is difficult to obtain a color selecting mechanism having a predetermined sectional profile, that is, having a stable quality.

SUMMARY OF THE INVENTION

An object of the invention is to provide a color selecting mechanism, a method of manufacturing the same and an etching process suited for such color selecting mechanism manufacture, which can meet a wide variety of specification scope requirements without need of complicated process of manufacture and also without limitations on the thickness of thin metal sheet used and also on the electron beam passage slit pitch.

DETAILED DESCRIPTION OF THE PREFERRED EMBODIMENTS

Figure 12A:
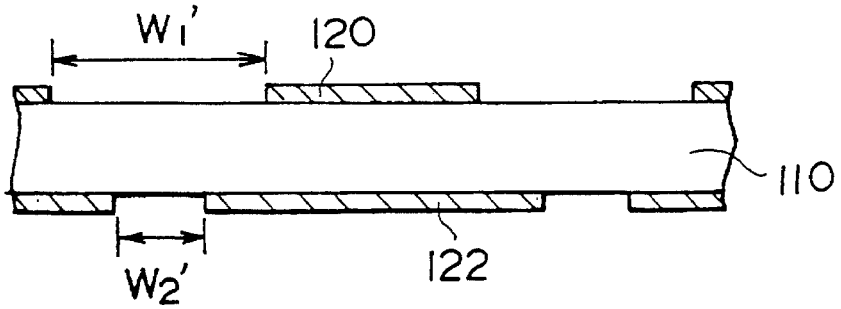
FIG.12A PRIOR ART
FIGS. 12A to 12C are schematic fragmentary sectional views showing a thin metal sheet in respective steps of a prior art single-step double-side etching process.
Figure 12B:
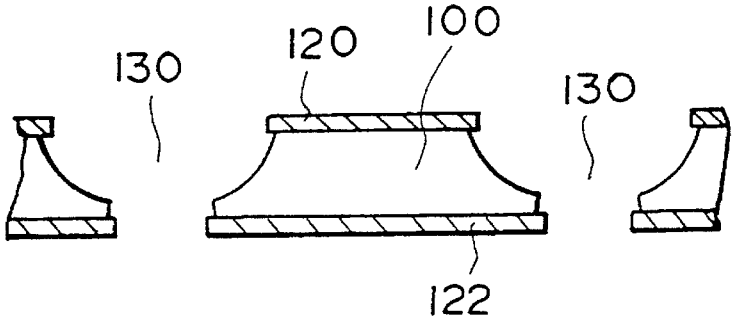
FIG.12B PRIOR ART
Figure 12C:
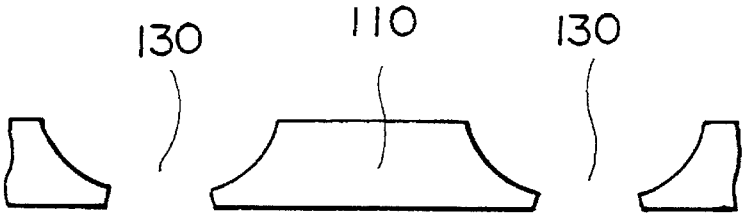
FIG.12C PRIOR ART
Figure 13A:
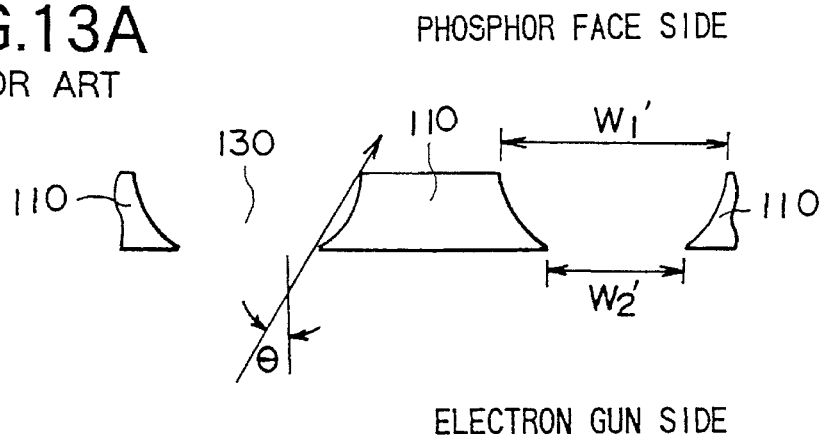
FIG.13A PRIOR ART
FIGS. 13A to 13C are views for describing the relation between the inclination angle of electron beam passage slit and the incidence angle of electron beam.
Figure 13B:
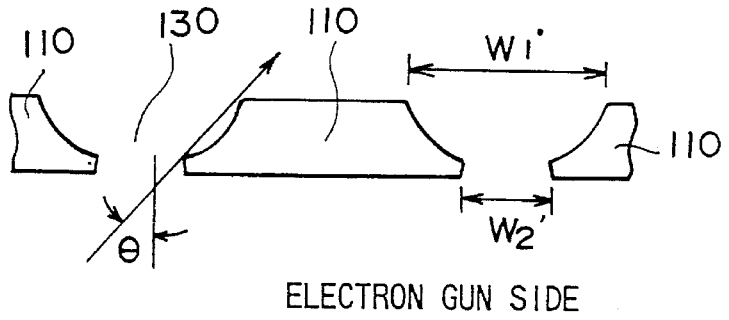
FIG.13B PRIOR ART
Figure 13C:
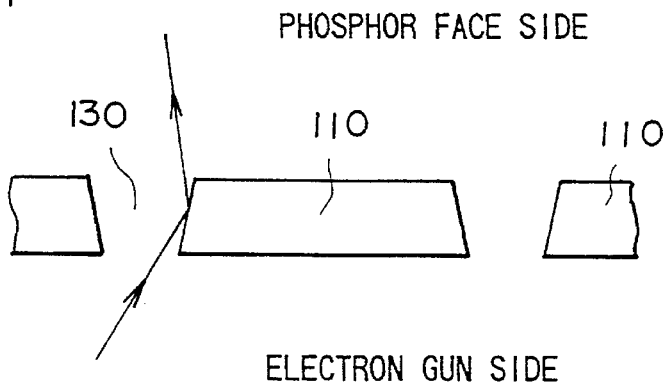
FIG.13C PRIOR ART

A technique shown in FIGS. 14A to 14E, is a method of color selecting mechanism manufacture commonly called a two-step double-side etching process, which has been provided for making up for the drawbacks in the singe-step double-side etching process described above in connection with FIGS. 12A to 12C and manufacturing a color selecting mechanism which has an accurate and stable quality. (Step 10B)

In this two-step double-side etching process, first a photosensitive etching resist is coated on both side surfaces of thin metal sheet 110. To define the width of electron beam passage slits 130 on the electron beam incidence side, slit-like openings with width $w_2'$ are formed in second photosensitive etching resist layer 122. Also, to obtain a desired sectional profile of the electron beam passage slits that are to be formed, slit-like openings with width $w_1'$ are formed in first photosensitive etching resist layer 120 (see FIG. 14A). These openings which are formed on the two surfaces of the thin metal sheet 110 have to be mutually positioned accurately. The openings in the first and second resist layers 120 and 122 provided on the front and back surfaces of the thin metal sheet 110, may be formed in a manner similar to the method described before in connection with the single-step double-side etching process.

The thin metal sheet 110 is etched in two stages.

(Step 20B)

Figure 14A:
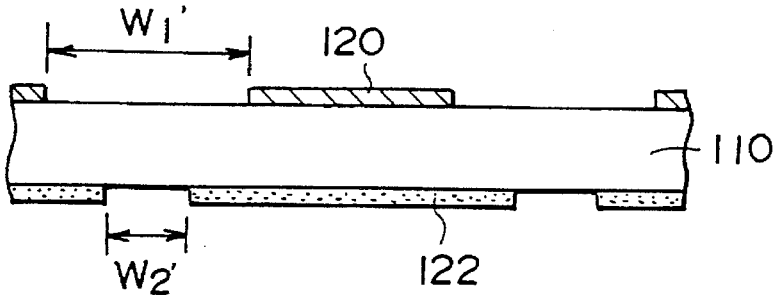
FIGS. 14A to 14E are schematic fragmentary sectional views showing a thin metal sheet in a two-step double-side etching process.
Figure 14B:
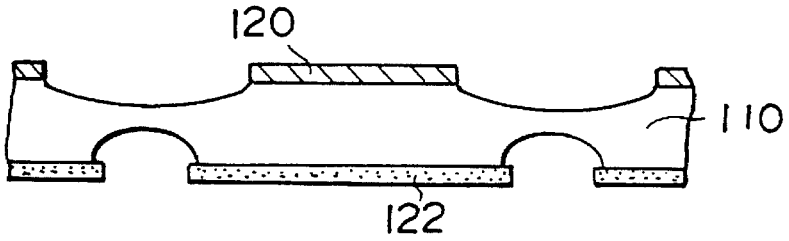

In a first stage of etching the thin metal sheet 110, such etching conditions are set that the thin metal sheet 110 is etched to a predetermined shape mainly through the width $w_2'$ openings formed in the second photosensitive etching resist layer 122. The thin metal sheet 110 is thus etched such that it has a sectional profile as shown in FIG. 14B. At this time, it is also partly etched through the width $w_1'$ openings formed in the second photosensitive etching resist layer 120 but not to an extent that any slit is formed.

(Step 30B)

Figure 14C:
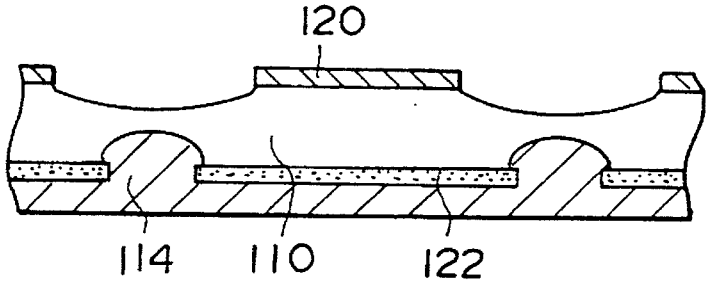
Figure 14D:
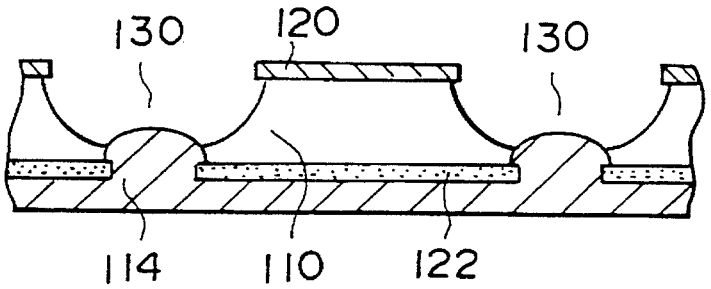

Subsequently, a protective layer 114 is formed by a coating process, for instance, on the second resist layer 122 and also on the back surface of thin metal sheet 110 that is exposed in the openings formed in the second resist layer 122 (see FIG. 14C). The protective layer 114 may be made of lacquers, etching resists and like materials having etching resistance, acid resistance and water resistance.

(Step 40B)

In this state, a second stage of etching is executed. In this stage, the thin metal sheet 110 is etched from its sole back surface through the openings formed in the second resist layer 120 (see FIG. 14D). Thus, the electron beam passage slits 130 are formed in the thin metal sheet 110. Since the protective layer 114 has been formed, the areas of the thin metal sheet 110 that were etched from the back surface thereof in the first stage of etching are not etched in the second stage.

(Step 50B)

Figure 14E:
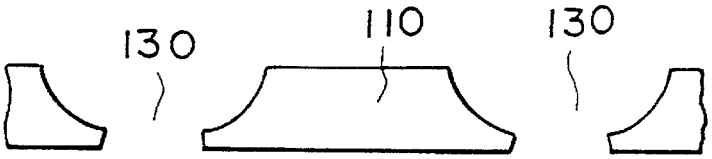

Afterwards, the first and second resist layers 120 and 122 and the protective layer 114 are separated from the thin metal sheet 110. In this way, a color selecting mechanism as shown in FIG. 14E can be produced, which comprises the thin metal sheet 110 with the electron beam passage slits 130 and has an accurate and stable quality.

The above two-step double-side etching process, however, requires two etching steps and further requires formation of the protective layer 114, thus dictating cumbersome manufacture of the color selecting mechanism. Besides, it is difficult to obtain stringent mutual positioning of a pair of, i.e., front and back, photosensitive etching resist masks.

Figure 15A:
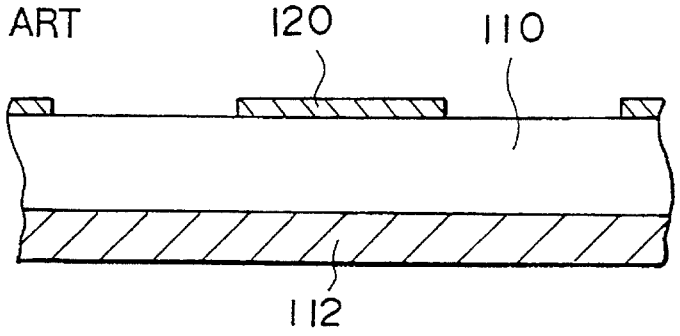
FIG.15A PRIOR ART
FIGS. 15A to 15C are views for describing prior art.

The applicant has proposed as U.S. Application Ser. No. 08/187911 filed Jan. 18, 1994 a technique for solving the problems in the two-step double-side etching process. In this technique, as shown in FIG. 15A, an adhesive film 112 is applied to the back surface of thin metal sheet 110. A photosensitive etching resist layer 120 with slit-like openings, on the other hand, is formed on the front surface of the thin metal sheet 110. The thin metal sheet 110 is then etched from its front surface side through the openings formed in the resist layer 120 (see FIG. 15B). Afterwards, the adhesive film 112 and the resist layer 120 are removed from the thin metal sheet 110. In this way, thin metal sheet 110 can be formed, which is shown in the schematic fragmentary section view of FIG. 15C. This thin metal sheet 110 has electron beam passage slits 130 having an inclination angle θ. By the term "inclination angle θ" is meant the maximum angle between a straight line in contact with a side wall of the slit 130 and the normal to the thin metal sheet 110.

The thin metal sheet 110 is generally very thin, and the adhesive film 112 also serves as a reinforcement material for the thin metal sheet 110. In addition, it can prevent damage to the thin metal sheet 110 before the sheet 110 is mounted in frame 140 after etching. As the adhesive film 112 may be used a commonly called laminate film. Further, by imparting the adhesive film 112 with reactivity, the film 112 can be readily separated from the thin metal sheet 110 by irradiating it with ultraviolet rays or by heating it.

With such method of color selecting mechanism manufacture using the adhesive film 112, the process is simplified compared to the single- or two-step double-side etching process shown in FIGS. 12A to 12C or 14A to 14E. The method, however, has a problem that the color selecting mechanism that can be manufactured is limited. Specifically, there is a limitation imposed on the pitch of electron beam passage slits formed in the color selecting mechanism. There is also a limitation on the thickness of the thin metal sheet for which the method can be adopted. In other words, the method can not be applied to a case of reducing the slit pitch or to a case using a thin metal sheet having a thickness smaller than a predetermined thickness or larger than a predetermined thickness.

Figure 15B:
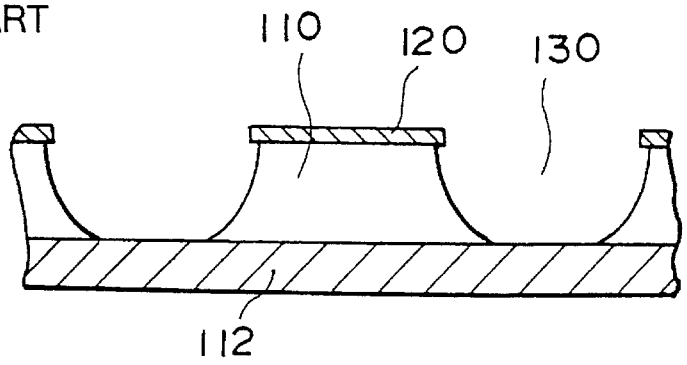
FIG.15B PRIOR ART
Figure 15C:
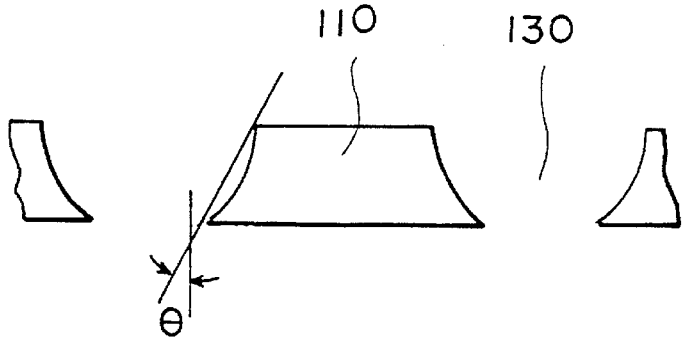
FIG.15C PRIOR ART

Besides, the inclination angle θ of the slits 130 as shown in FIG. 15C is limited. The inclination angle may be controlled accurately if it is a certain angle (for instance θ=15°). In such case, the slits 130 can be formed accurately. However, where the inclination angle θ required for the slits 130 is greater than 15°, the slits 130 may not be formed accurately. This problem arises pronouncedly when manufacturing a color selecting mechanism for, for instance, a large size television receiver picture tube (for instance a 110° deflection cathode-ray tube for 29-inch type).

Embodiment 1

In the etching process and the method of manufacturing a color selecting mechanism in Embodiment 1 of the invention, a photosensitive etching resist layer is formed with first and second parallel slit-like openings. The second opening is formed on the outer side of the first opening when viewed from the center of the work.

Embodiment 1 more specifically concerns a method of manufacturing an aperture grill type color selecting mechanism for a "Trinitron" type color picture tube used for a large size color television receiver, for instance.

Figure 1:
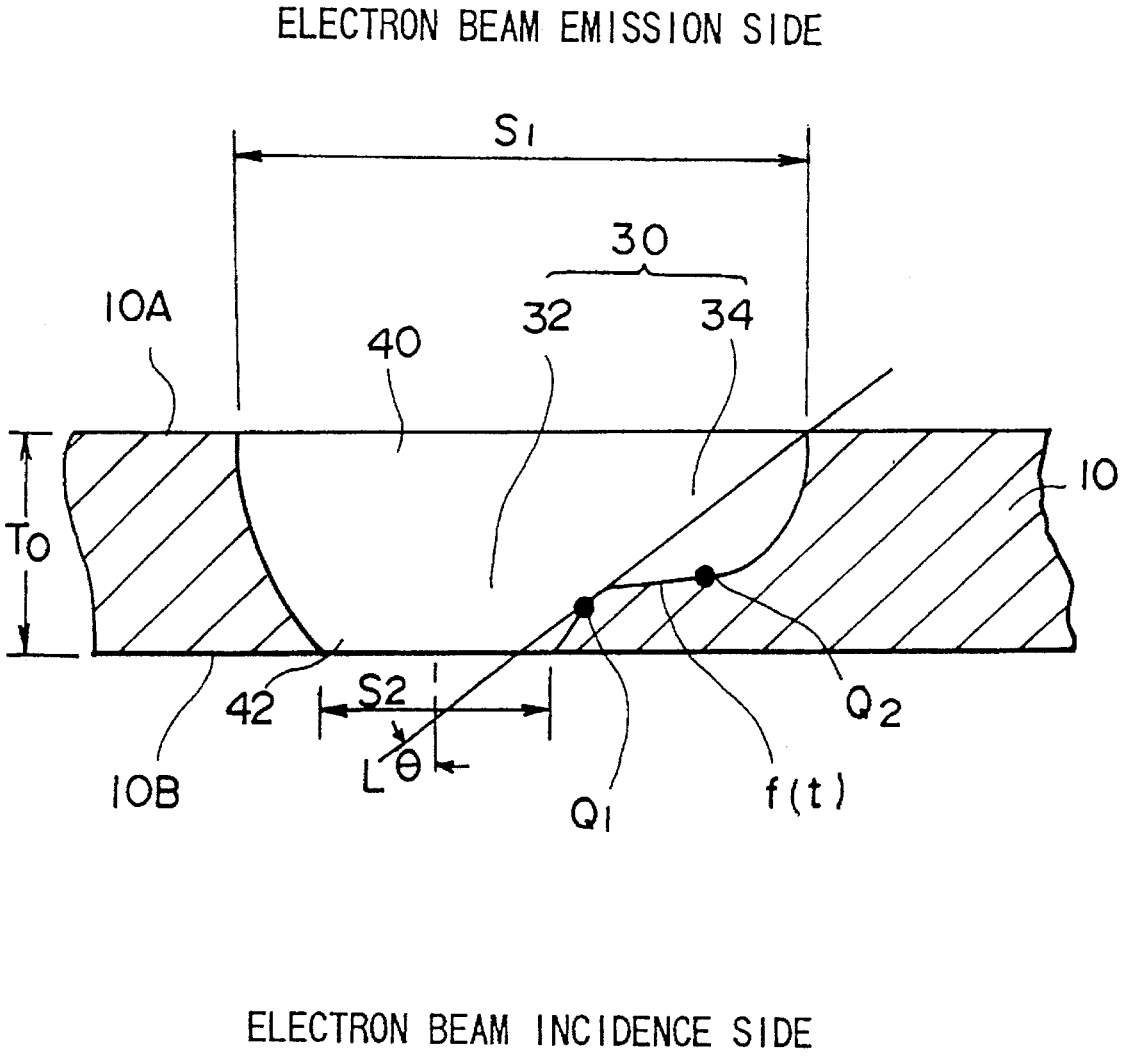
FIG. 1 is a schematic fragmentary sectional view showing a work or color selecting mechanism in Embodiment 1.

FIG. 1 is a schematic fragmentary sectional view showing a work (or a color selecting mechanism) in Embodiment 1 after etching. The work after etching may also be referred to as product of etching. The product of etching ( i.e., color selecting mechanism) comprises a work (i.e., iron type thin metal sheet) 10 with slits 30 formed therein. The slits 30 each consist of a slit zone 32 and a recess 34 formed on one side of the slit zone 32. A plurality of slits 30 are formed in the work (color selecting mechanism) 10, but only one of them is shown in FIG. 1.

The recess 34 is found on the outer side of the slit zone 32 (i.e., right side of the slit zone 32 in FIG. 1) when viewed from the center (located at a leftward position in FIG. 1) of the slit zone 32. The slit 30 has an opening area 40 which is defined on the side of the front surface 10A of the work 10 defined by the slit zone 32 and the recess 34, and also has an opening area 42 defined on the side of the back surface 10B of the work 10 by the slit zone 32. The opening area 40 is greater in size (corresponding to width $S_2$ in Embodiment 1) than the opening area 42 (corresponding to width $S_2$ in Embodiment 1). The openings 40 and 42 have slit-like plan shapes.

In the color selecting mechanism, an electron beam passes through each slit 30. In the section of the slit 30 in the direction of the thickness of the iron type thin metal sheet 10, a portion of the side walls of the slit 30 (i.e., a portion of the side walls of the slit constituted by the slit zone 32 and the recess 34 in Embodiment 1) is a curve given as f(t), where t is the thickness of the iron type thin metal sheet 10. As shown in FIG. 1, over the entire range of the first degree derivative of the curve f(t) has a positive or negative value which may be zero, the value being dependent on the way of taking the origin of coordinates. Besides, the curve f(t) has at least one inflection point. In Embodiment 1, the curve f(t) has two inflection points $Q_1$ and $Q_2$. The maximum angle between the straight line L in contact with the curve f(t) and the normal to the iron type thin metal sheet 10 is defined as inclination angle θ.

In the slit 130 of the color selecting mechanism shown in FIGS. 12A to 12C and 14A to 14E, the first degree derivative of the side wall curve of the slit 130 has both positive and negative values. Further, such side wall curve of the slit 130 is discontinuous and not smooth. On the other hand, in the slit 130 of the color selecting mechanism shown in FIGS. 15A to 15C, the first degree derivative of the slit wall curve does not have any inflection point although it has a positive or negative value.

Now, the etching process or the method of manufacturing a color selecting mechanism will be described with reference to schematic fragmentary sectional views of work shown in FIGS. 2A, 2B and 3A to 3C. In Embodiment 1, a thin iron sheet about 0.08 mm in thickness is used as the work (iron type thin metal sheet) 10, and an aqueous solution of ferrous chloride ($FeCl_3$) is used as the etching solution.

(Step 100)

First, a photosensitive etching resist layer 20 is formed on the front surface 10A of the work (iron type thin metal sheet) 10, and also a protective layer 12 is formed on the back surface 10B of the work 10. Specifically, a photosensitive etching resist solution is coated on the front surface 10A of the work 10 which is a flat, elongate thin metal sheet after fat removal and washing of the front and back surfaces. The photosensitive etching resist solution is composed of, for instance, casein and 1% by weight of ammonium dichromate with respect to casein. The resist solution is then dried using a heater at 80° to 100° C. As a result, a photosensitive etching resist layer 20 with a thickness of 7 to 10 m is formed on the front surface 10A of the work 10.

Subsequently, a laminate film comprising a polyester film with an adhesive which can be readily removed from the work by irradiating it with infrared radiation, is laminated on the back surface 10B of the work 10. In this way, the protective layer 12 consisting of the laminate film is formed on the back surface 10B of the work 10. As an alternative, it is possible to coat the photosensitive etching resist solution on both the front and back surfaces 10A and 10B of the work 10, thus forming a photosensitive etching resist layer on the back surface 10B of the work 10 as well, and form the protective layer 12 on that resist layer.

(Step 110)

Figure 2A:
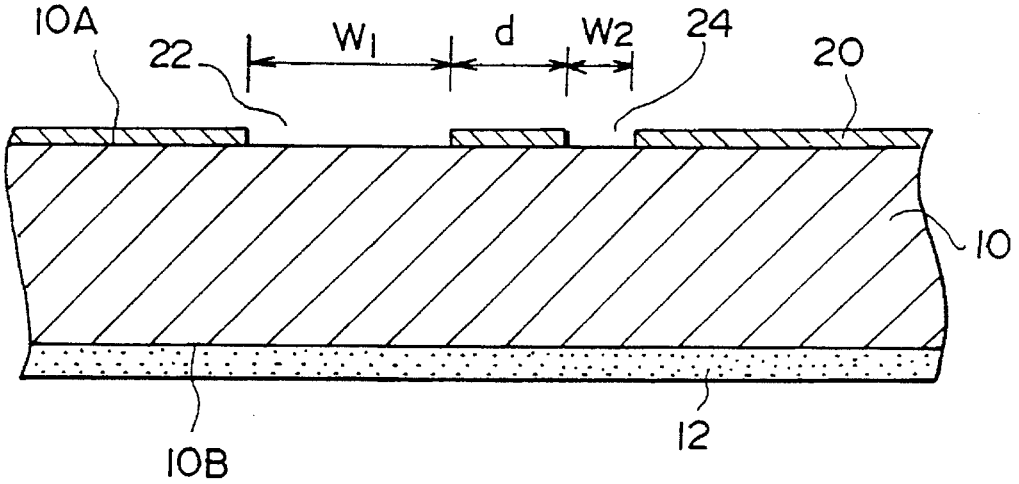
FIGS. 2A and 2B are a schematic fragmentary sectional view and a schematic fragmentary plan view, respectively, showing a work or an iron type thin metal sheet for describing an etching process or a method of manufacturing a color selecting mechanism in Embodiment 1.
Figure 2B:
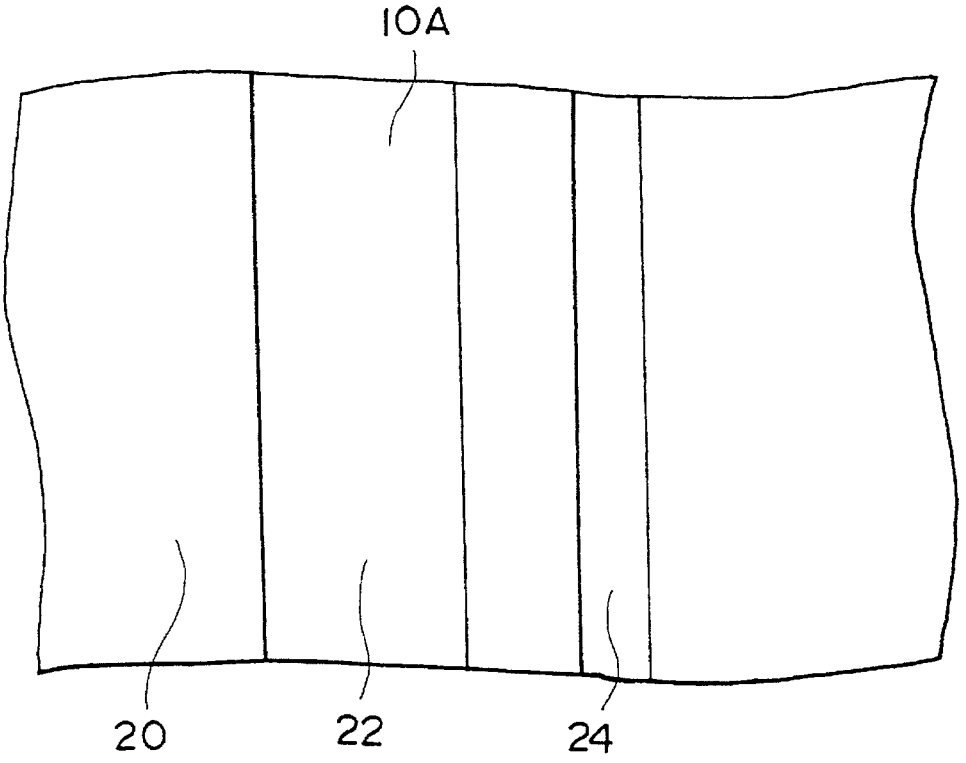

The photosensitive etching resist layer 20 is then patterned to form each first opening 22 in its portion over a slit formation area of the work (iron type thin metal sheet) 10 and also each second opening 24 smaller than the first opening 22 in its portion near the first opening 22. This state is shown in the schematic fragmentary sectional view of FIG. 2A and in the schematic fragmentary plan view of FIG. 2B. In FIG. 2B, the photosensitive etching resist layer 20 is shown shaded.

In Embodiment 1, the first and second openings 22 and 24 formed in the photosensitive etching resist layer 20, as shown in FIG. 2B, are parallel to one another and have a slit-like shape. Each second opening 24 is formed in a portion of the resist layer 20 on the outer side of the associated first opening 22 (i.e., on the right side of the first opening 22 in FIGS. 2A and 2B) when viewed from the center of the work (located at a leftward position in FIGS. 2A and 2B).

Specifically, a separately prepared photosensitive etching resist mask is held in close contact with the surface of the photosensitive etching resist layer 20 formed on the front surface 10A of the work 10, and then exposure and fixing are executed using a metal halide lamp or like ultraviolet radiation source, followed by development with water. In this way, the photosensitive etching resist layer 20 is patterned to form a desired etching pattern. Where the resist layer 20 is removed, the front surface 10A of the work 10 is exposed. The resist layer 20 may be exposed and developed in a usual way by using a usual resist exposing and developing apparatus.

The widths $W_1$ and $W_2$ of the first and second openings 22 and 24 and the edge-to-edge distance d between the first and second openings 22 and 24 (which may also referred to as vicinity distance) depend on:

(A) the etching conditions, (B) the thickness of the work (iron type thin metal sheet) used, and (C) the sizes of the opening areas 40 and 42 (to be described later) that are required (for instance, widths $S_1$ and $S_2$). Further, in the manufacture of a color selecting mechanism, these factors depend on:

(D) the electron beam deflection angle in cathode-ray tube (CRT), and (E) the electron beam permeability that is required.

Afterwards, if necessary, using a resist hardening apparatus, the photosensitive etching resist layer 20 is dipped in 5 to 10% chromic acid to harden it and then washed with water, followed by its patterning (thermal treatment) at 200° to 250° C. using a patterning apparatus. Doing so is desired for improving the etching resistance of the resist layer 20.

(Step 120)

Subsequently, the work 10 is etched to form the slit zone 32 in the work material under the first opening 22 in the resist layer 20 and also form the recess 34 in the work material under the second opening 24, while removing at least a portion of work material between the slit zone 32 and the recess 34.

Figure 3A:
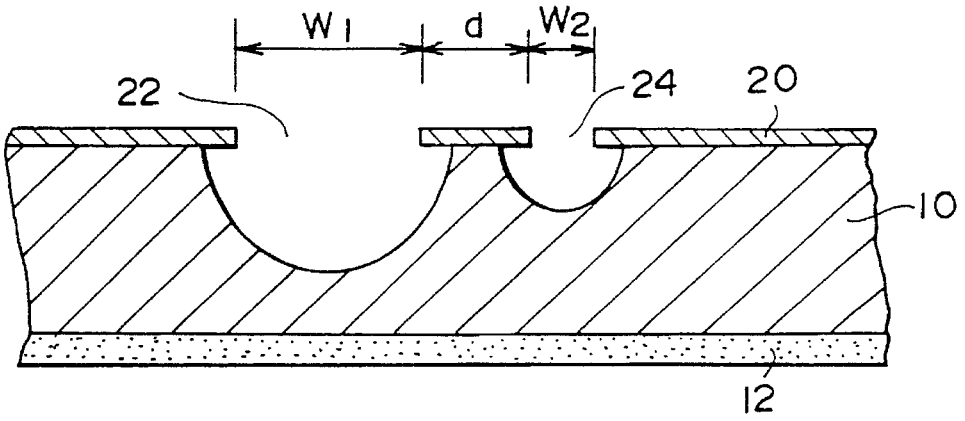
FIGS. 3A to 3C are schematic fragmentary sectional views showing a work or an iron type thin metal sheet in respective steps for describing the etching process or the method of manufacturing the color selecting mechanism in Embodiment 1.
Figure 3B:
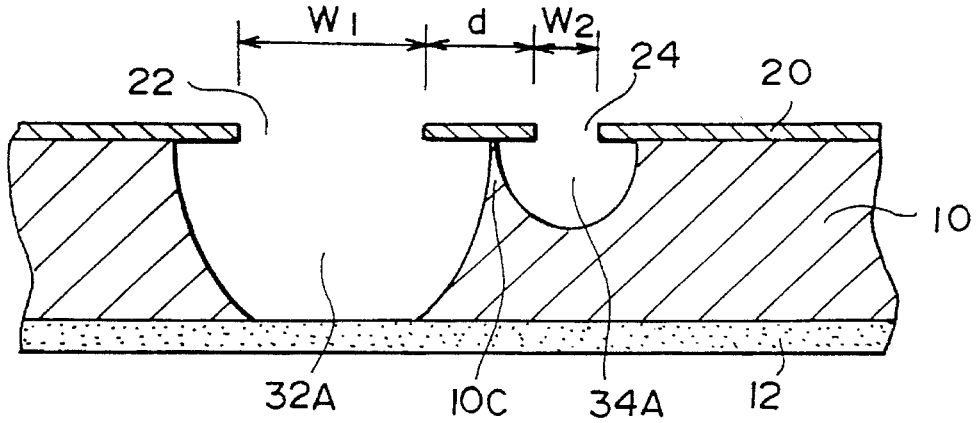

More specifically, by commencing the etching of the work 10 from the side of the front surface 10A, the work 10 begins to be etched through the first and second openings 22 and 24, as shown in FIG. 3A. With the progress of the etching, as shown in FIG. 3B, a slit zone 32A is formed in the work 10 under the first opening 22 as a result of the etching of the work 10 through the first opening 22. At the same time, a recess 34A is formed in the work 10 under the second opening 24 as a result of the etching of the work 10 through the second opening 24. The recess 34A does not penetrate the work 10. In this stage, the slit zone 32A and the recess 34A are spaced apart by a portion 10C of the work material.

Figure 3C:
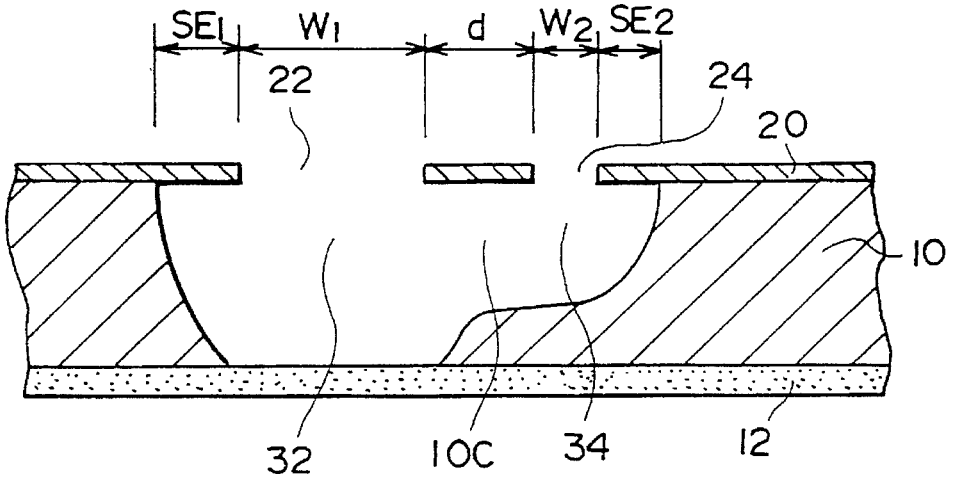

With further progress of the etching, eventually the slit zone 32 penetrating the work 10 and the recess 34 on one side of the slit zone 32 are formed as shown in FIG. 3C. The recess 34 does not penetrate the work 10. In the final stage of etching as shown in FIG. 3C, the work material portion 10C that has been separating the slit zone 32 and the recess 34 shown in FIG. 3B is etched away. When the work material portion 10C separating the slit zone 32 and the recess 34 turns to be etched, the portion of the photosensitive etching resist layer 20 that extends between the first and second openings is liable to be ruptured.

(Step 130)

After completion of the etching, the photosensitive etching resist layer 20 remaining on the front surface 10A of the work 10 is separated by using a high temperature aqueous alkali solution, and also the protective layer 12 is separated from the back surface 10B of the work 10 by irradiating the layer 12 with ultraviolet radiation. In this way, a product of etching (i.e., a color selecting mechanism) as shown in FIG. 1 can be obtained.

The size (width $S_1$) of the opening area 40 defined on the side of the front surface 10A of the work 10 by the slit zone 32 and the recess 34, is determined by the sizes of and relative positional relation between the first and second openings 22 and 24 in the resist layer 20, etching conditions, etc. The size of the opening area 42 defined on the side of the back surface 108 of the work 10 by the slit zone 32, on the other hand, is determined by the size of each first opening 22 in the resist layer 20, etching conditions, etc. These opening areas 40 and 42 have slit-like shapes in plan view.

The work 10 is usually etched isotropically, and thus commonly called side etching is generated. Specifically, portions of the work 10 right under portions of the resist layer 20 near the first and second openings 22 and 24 are etched. Consequently, the resist layer 20 extends from the opposed edges of the slit zone 32 and recess 34.

Referring to FIG. 3C, the extent of side etching of the work 10 in the slit zone 32 is denoted by $SE_1$, and the extent of side etching of the material 10 in the recess 34 by $SE_2$. Each side etching extent corresponds to the length of extension of the resist layer 20 from the edge of the slit zone 32 or the recess 34 in the work 10 under the assumption that the resist layer 20 is not ruptured in the etching process.

The vicinity distance d is desirably greater than one half the sum ($SE_1$+$SE_2$) of the two side etching extents. Or it is desirably one to 2 times, preferably one to 1.5 times, the side etching extent $SE_1$ of the work 10 in the slit zone 32. By setting d in this range, it is possible to readily and accurately form the slit 30 having predetermined size or dimensions (such as widths $S_1$ and $S_2$)

The size (width) $W_2$ of the second opening is desirably 0.8 to 3.0 times, preferably 0.8 to 1.5 times, the side etching extent $SE_2$ of the work in the recess 34. Or the width $W_2$ of the second opening is suitably between one-third and two-third of the thickness of the work (iron type thin metal sheet) 10.

It is possible that all the slits 30 formed in the product of etching (color selecting mechanism) have respective recesses 34. In this case, the second opening 24 is provided for each of the first openings 22 formed in the resist layer 20.

Alternatively, only some of the slits 30 formed in the product of etching (color selecting mechanism) may have respective recesses 34. In this cases, second openings 24 are provided in correspondence to some of the first openings 22. It is desirable to provide second openings not for first openings at the center and nearby areas of the work (iron type thin metal sheet) but for first openings in edge areas of the work. If the angle of electron beam incidence on a slit 30 at the center or nearby area of the color selecting mechanism is smaller than the inclination angle of that slit 30, such a slit 30 may not include the recess 34. In this case, the sectional profile of the slit 30 is as shown in FIG. 15B. However, the deflection angle of an electron beam incident on an edge portion of the color selecting mechanism is greater than that incident on a central portion thereof. Thus, it is desirable that the slit 30 includes the recess 34 for the color selecting mechanism area in which the angle of electron beam incidence on the slit 30 is greater than the inclination angle θ of the slit 30 (for instance, a color selecting mechanism area in which the electron beam incidence angle is 20° or above).

In the etching process and the method of manufacturing a color selecting mechanism in Embodiment 1, the second opening 24 is formed in a portion of the photosensitive etching resist layer 20 on the outer side of the first opening 22 when viewed from the center of the work (i.e., iron type thin metal sheet). In addition, it is possible to form the second openings 24 such that one encounters greater recesses 34 as one goes away from the center of the work (iron type thin metal sheet). By the term "one encounters greater recesses 34 as one goes away from the center of the work" is meant that the size (for instance width $S_1$) of the opening area 40 defined on the side of the front surface 10A of the work (i.e., iron type thin metal sheet) 10 is the greater the the further one is separated from the center of the work (iron type thin metal sheet).

For forming the second openings 24 such that the recesses 34 are progressively greater as one goes away from the work center, not only the size of the second opening but also the vicinity distance d may be increased.

It is possible to provide a predetermined relation (for instance a relation represented by a first degree function) between the size of the recess 34 and the distance between the center of the-work (color selecting mechanism) to the slit 30 or, in the color selecting mechanism, the incidence angle (or deflection angle) of electron beam.

Embodiment 2

Figure 4:
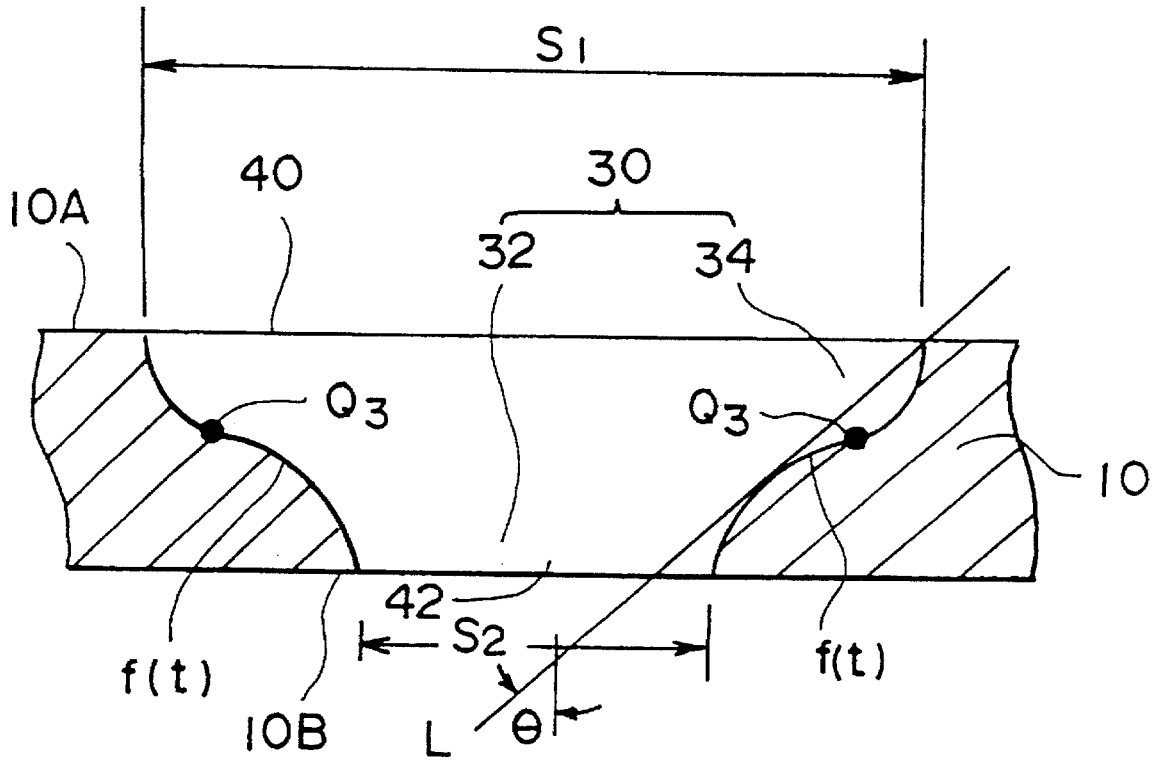
FIG. 4 is a schematic fragmentary sectional view showing a work or a color selecting mechanism in Embodiment 2.

Embodiment 2 is a modification of Embodiment 1, and it is the same as Embodiment 1 except for that second opening 24 is formed on each side of first opening 22 in photosensitive etching resist layer 20. FIG. 4 is a schematic fragmentary sectional view showing a product of etching or a color selecting mechanism obtained by etching in Embodiment 2. In this product of etching or color selecting mechanism, slit 30 comprises a slit zone 32 and recesses 34 each formed on each side of the slit zone 32. In other words, the two recesses 34 are located on the inner and outer sides, respectively, of the slit zone 32 (i.e., on the left and right sides of the slit zone 32 in the figure) when viewed from the center of the work (or color selecting mechanism) which is located at a leftward position in the figure. Opening areas 40 and 42, like Embodiment 1, have slit-like shapes.

In this color selecting mechanism, in the section of the slit 30 in the thickness direction of the iron type thin metal sheet, a portion of the side walls of the slit 30 (i.e., a portion of slit side wall defining the slit zone 32 and each recess 34 in Embodiment 2), is represented by a curve f(t). As shown in FIG. 4, over the entire range of t the first degree derivative of the curve f(t) has a positive or negative value which may be zero. In addition, in Embodiment 2 the curve f(t) has an inflection point Q. The maximum angle between the curve f(t) and the normal to the iron type thin metal sheet 10 is defined as inclination angle θ.

Figure 5A:
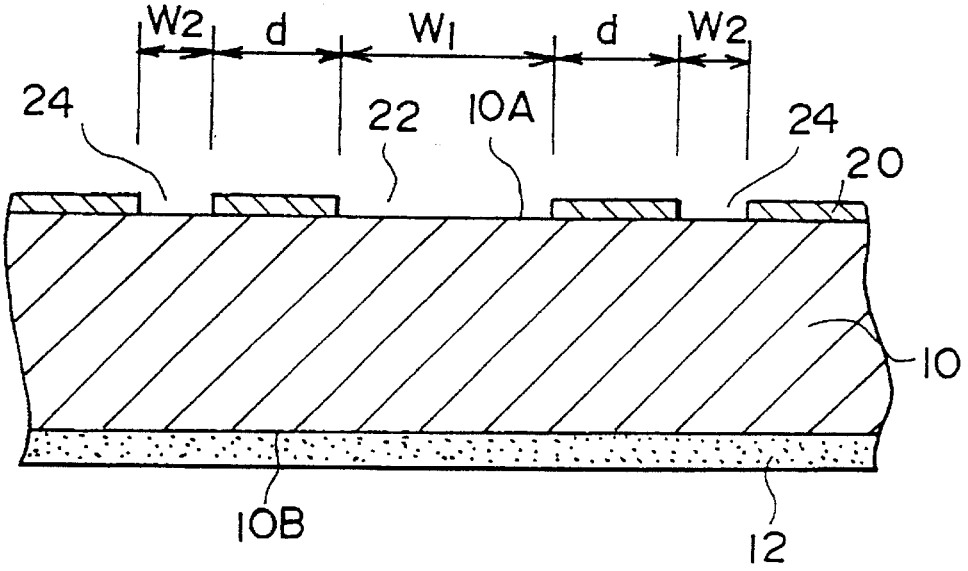
FIGS. 5A and 5B are schematic fragmentary sectional views showing the work or the iron type thin metal sheet in respective steps for describing the etching process or the method of manufacturing the color selecting mechanism in Embodiment 2.
Figure 5B:
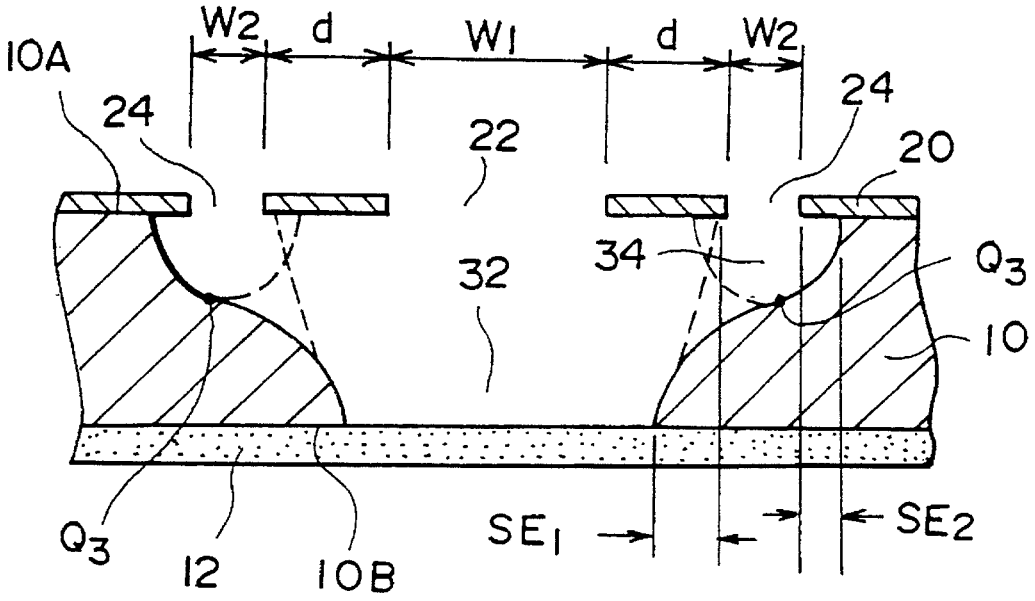
Figure 6A:
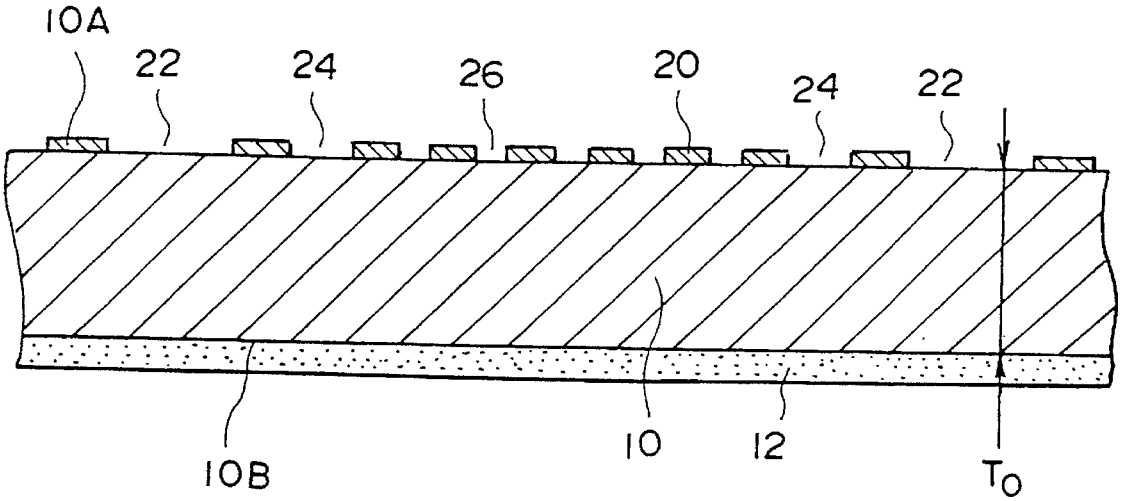
FIGS. 6A and 6B are a schematic fragmentary sectional view and a fragmentary plan view, respectively, showing a work or an iron type thin metal sheet for describing an etching process or a method of manufacturing a color selecting mechanism in Embodiment 3.
Figure 6B:
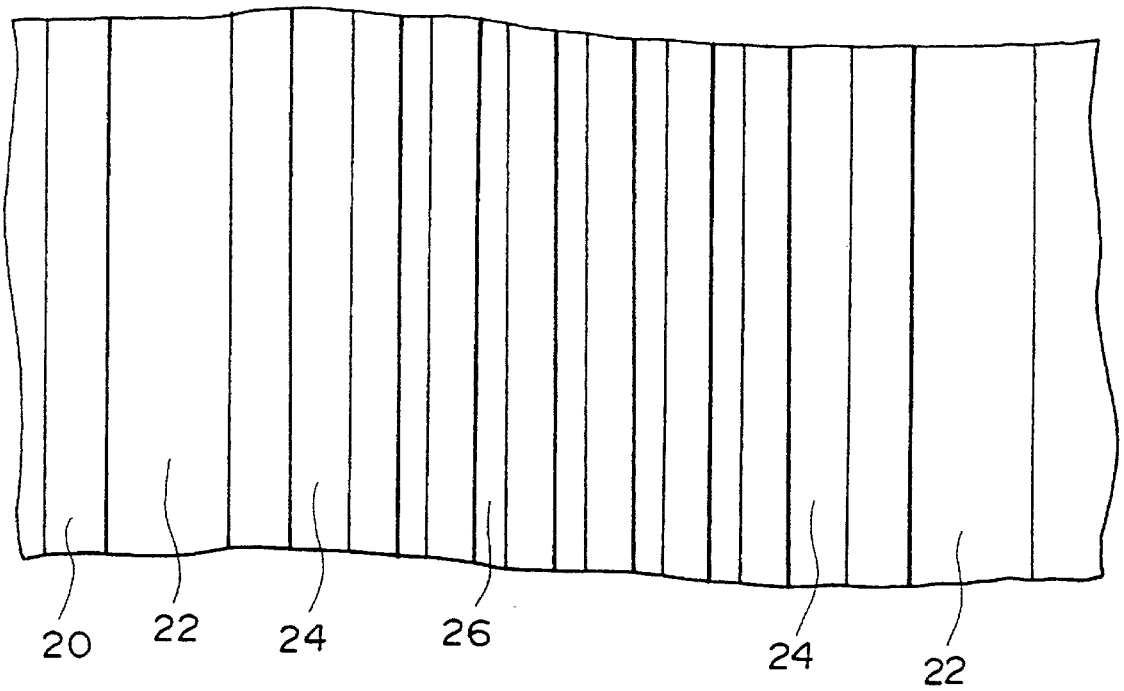

Now, the etching process and the method of manufacturing a color selecting mechanism in Embodiment 2 will be described with reference to the schematic fragmentary sectional views of FIGS. 5A and 5B showing a work. In Embodiment 2, a thin iron sheet with a thickness of about 0.05 mm is used as work (iron type thin metal sheet) 10, and an aqueous solution of ferrous chloride ($FeCl_3$) is used as etching solution.

(Step 200)

First, as in (Step 100) in Embodiment 1, an etching resist layer 20 is formed on the front surface 10A of the work (iron type thin metal sheet), and also the protective layer 12 is formed on the back surface 10B of the work 10.

(Step 210)

The resist layer 20 is then patterned to form the first opening 22 in a slit formation area of the resist layer on the work (iron type thin metal sheet) 10 and the second openings 24 smaller than the first opening 22 in resist layer portions on the opposite sides and near the first opening 22 (see FIG. 5A). In Embodiment 2, the first and second openings 22 and 24 formed in the etching resist layer 20 are parallel to one another and slit-like in shape. The second openings 24 are formed in portions of the etching resist layer 20 on the inner and outer sides of the first opening 22 (i.e., on the left and right sides of the first opening 22 in FIG. 5A) when viewed from the center of the work (which is located leftward in FIG. 5A).

Specifically, the openings 22 and 24 may be formed in the same manner as in (Step 100) in Embodiment 1. In a specific example, the widths $W_1$ and $W_2$ of the first and second openings 22 and 24 were set to about 160 and about 30 μm, and the vicinity distance d was set to about 40 μm.

Subsequently, resist hardening and patterning (thermal treatment) are carried out, if necessary.

(Step 220)

Then, the work (iron type thin metal sheet) 10 is etched to form the slit zone 32 in the work material under each fist opening 22 formed in the etching resist layer 20, and also the recesses 34 in the work material portions under the associated second openings 24, while removing the work materials spacing apart the slit zone 32 and the recesses 34 (see FIG. 5B). Shown by phantom lines in FIG. 5B are an imaginary sectional view of the work (iron type thin metal sheet) when it is assumed that the work (iron type thin metal sheet) 10 is etched separately through the first and second openings 22 and 24 of the widths $W_1$ and $W_2$. When the work material portions spacing apart the slit zone 32 and the recesses 34 are etched, the portions of the resist layer 20 between the first and second openings 22 and 24 are liable to be ruptured.

(Step 230)

After completion of the etching, the etching resist layer 20 remaining on the front surface 10A of the work 10 is separated by using a high temperature aqueous alkali solution, and also protective layer 12 is separated from the back surface 10B of the work 10 by irradiating the layer 12 with ultraviolet radiation. In this way, a product of etching (i.e., color selecting mechanism) having the structure as shown in FIG. 4 can be obtained.

It is possible to provide the recesses 34 for all the slits 30 formed in the product of etching (color selecting mechanism). In this case, the recesses 24 are provided on the opposite sides of all the first openings 22 formed in the etching resist layer 20.

Alternatively, as in Embodiment 1, the recesses 34 may be provided on the opposite sides of some of the slits 30 formed in the product of etching (i.e., color selecting mechanism). Further, the slits described before in connection with Embodiments 1 and 2 may coexist. That is, in some area of the product of etching (color selecting mechanism) a recess 34 is provided on one side of the slit zone 32, while in other area of the product of etching (color selecting mechanism) recesses 34 are provided on the opposite sides of the slit zone 32.

In the etching process and the method of manufacturing a color selecting mechanism in Embodiment 2, the second openings 24 are formed in portions of the etching resist layer 20 on the opposite sides of each first opening 22 when viewed from the center of the work. Besides, the second openings 24 may be formed such that the recesses 34 are progressively greater as one goes from the center of the work. Further, it is possible to provide a predetermined relation (for instance a relation represented by a first degree function) between the size of the recess 34 and the distance from the center of the product of etching (color selecting mechanism) or, in the color selecting mechanism, the incidence angle (or delfection angle) of electron beam.

Embodiment 3

In the etching process and the method of manufacturing a color selecting mechanism in Embodiment 3, unlike Embodiments 1 and 2, as the work is etched in its thickness direction during the etching process, etching resist layer portions between first and second openings are ruptured. Further, at least one third opening is formed in an etching resist layer portion between adjacent second openings. In the etching of the work, the thickness of the work under the third opening or openings is controlled by prescribing the number, position and opening area of the third opening or openings.

Again in Embodiment 3, the first to third openings formed in the etching resist layer are parallel to one another and slit-like in shape. In Embodiment 3, like Embodiment 2, the second openings are formed in resist layer portions on the inner and outer sides of the first opening when viewed from the center of the work. A plurality of third openings are formed in the resist layer portion between adjacent second openings.

The color selecting mechanism in Embodiment 3 is of aperture grill type. It is formed by etching an iron type thin metal sheet having a predetermined thickness $T_0$.

Figure 8A:
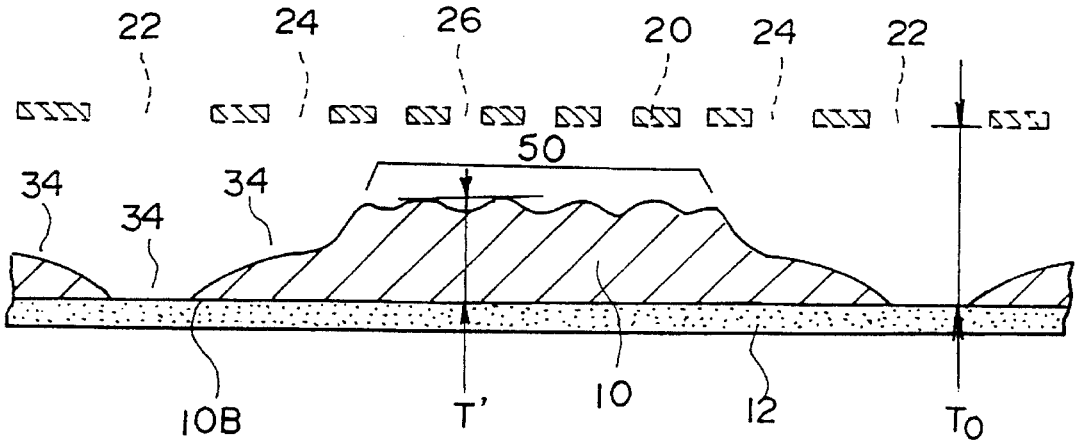
FIGS. 8A and 8B are schematic fragmentary sectional views showing the work or the iron type thin metal sheet, i.e., color selecting mechanism, in respective steps for describing the etching process or the method of manufacturing the color selecting mechanism in Embodiment 3.
Figure 8B:
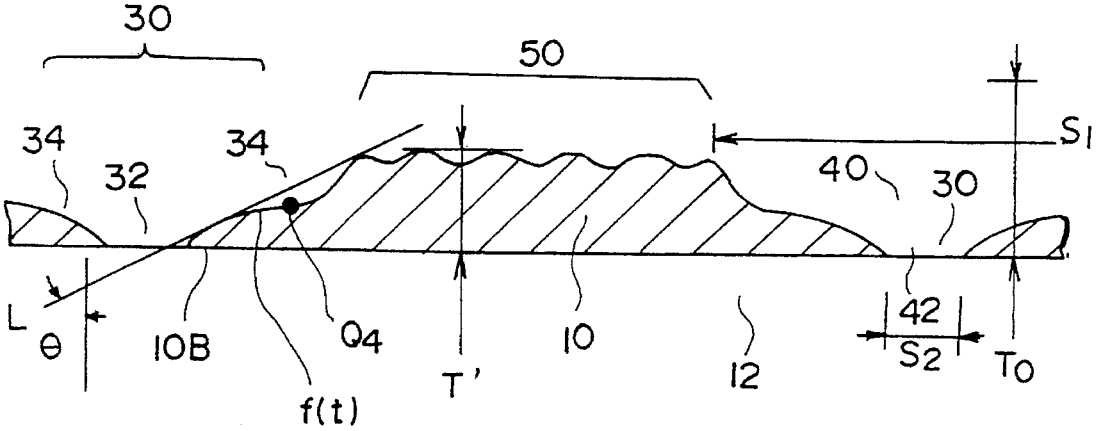

FIG. 8B is a schematic fragmentary sectional view showing the product of etching (i.e., color selecting mechanism) in Embodiment 3. This product of etching (color selecting mechanism) comprises the work (iron type thin metal sheet) 10 with a plurality of slits 30 formed therein. Electron beams pass through these slits 30. The slits 30 each comprise a slit zone 32 and recesses 34 formed on the opposite sides of the slit zone 32. A plurality of slits 30 are formed in the work or color selecting mechanism.

The recesses 34 are found on the inner and outer sides of the slit zone 32 (i.e., on the left and right sides of the slit zone 32 in FIG. 8B) when viewed from the center of the product of etching (color selecting mechanism) (which is found leftward in the figure). The slit 30 has an opening area 40 defined on the side of the front surface of the product of etching (color selecting mechanism) by the slit zone 32 and recesses 34 and also an opening area 42 defined on the side of the back surface 10B of the work 10 by the slit zone 32. The opening area 40 corresponds to the opening area of the slit on the electron beam emission side of the color selecting mechanism. The opening area 42, on the other hand, corresponds to the opening area of the slit on the electron beam incidence side of the color selecting mechanism. The size of the opening area 40 (which corresponds to width $W_1$ in Embodiment 3) is greater than the size of the opening area 42 (which corresponds to width S in Embodiment 3). The openings 40 and 42 are slit-like in plan view shape. Between adjacent slits 30, the color selecting mechanism has an irregular surface area 50 formed on the electron beam emission side. In the irregular surface area 50, the thickness T' of the iron type thin metal sheet 10 is less than a predetermined thickness $T_0$ thereof before the etching.

In the color selecting mechanism, electron beams pass through the slits 30. In the section of the slit in the thickness direction of the iron type thin metal sheet (i.e., a portion of the side walls of the slit constituted by the slit zone 32 and recesses 34 in Embodiment 3), a side wall portion of the slit is a curve f(t) as in Embodiment 1, t being the thickness of the iron type thin metal sheet. As shown in FIG. 8B, in the entire range of t the curve f(t) has a positive or negative value which may be zero. The positive or negative value depends on the way of taking the coordinate origin. Besides, in Embodiment 3 the curve f(t) has an inflection point $Q_4$. The maximum angle between a straight line L tangent to the curve f(t) and the normal to the color selecting mechanism is defined as inclination angle θ.

In Embodiment 3, unlike Embodiment 1, the recess and the irregular surface area 50 smoothly terminate in each other, and their boundary may not be clear. In such a case, as the boundary between the recess 34 and the irregular surface area 50 may be defined a surface portion which contains one of the points of contact between the side wall portion of the slit 30 represented by the curve f(t) and the straight line L that is closest to the front surface of the product of etching (color selecting mechanism) on the electron beam emission side.

Now, the etching process and the method of manufacturing a color selecting mechanism in Embodiment 3 will be described with reference to the schematic fragmentary views of FIGS. 6A to 8B. In Embodiment 3, a thin iron sheet with a thickness of about 0.08 mm is used as the work (iron type thin metal sheet) 10, and an aqueous solution of ferrous chloride ($FeCl_4$) as etching solution.

(Step 300)

First, as in (Step 100) in Embodiment 1, etching resist layer 20 is formed on the front surface 10A of work (iron type thin metal sheet) 10, and also protective layer 12 is formed on the back surface 10B of the work 10.

(Step 310)

Then, the etching resist layer 20 is patterned to form first opening 22 in its portion over a slit formation area of the work (iron type thin metal sheet) 10 and second openings 24 smaller than the first opening 22 in its portions near the opposite sides of the first opening 22. Further, a plurality of (i.e., five in Embodiment 3) third openings 26 are formed between adjacent second openings 24 (see the schematic fragmentary sectional view of FIG. 6A and the schematic fragmentary plan view of FIG. 6B). In Embodiment 3, the first to third openings 22 to 26 are parallel to one another and slit-like in shape. The second openings 24 are formed in portions of the etching resist layer 20 on the inner and outer sides of the associated first opening 22 (i.e., the left and right sides of the first opening 22 in FIG. 6A), when viewed from the center of the work (which is located leftward in FIG. 6A).

The openings 22, 24 and 26 may be formed specifically in the same manner as in (Step 110) in Embodiment 1.

Subsequently, resist hardening and patterning are executed, if necessary.

(Step 320)

Thereafter, the work 10 is etched to form slit zone 32 in a portion of the work 10 under each first opening 22 formed in the resist layer 20 and recesses 34 in portions of the work 10 under the second openings 24, while removing at least portions of the work that have spaced apart the slit zone 32 and the recesses 34. Further, the etching proceeds on portions of the work 10 under the third openings 26, whereby irregular surface area 50 is formed to obtain control of the thickness T' of the work 10 (i.e., reduction of the work thickness). The thickness T' of the work 10 may be controlled by prescribing the number, position and opening area (for instance width) of the third opening or openings 26.

Figure 7A:
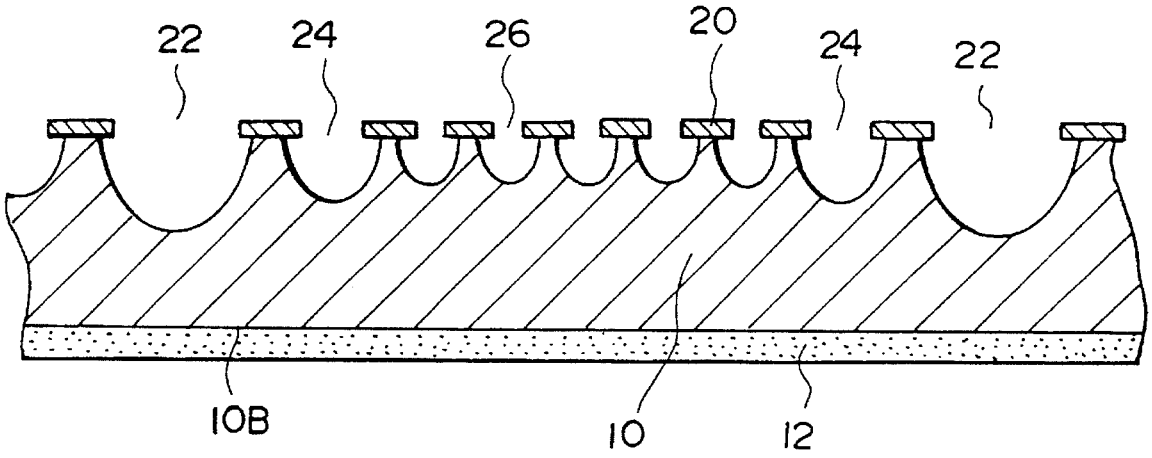
FIGS. 7A and 7B are schematic fragmentary sectional views showing the work or the iron type thin metal sheet in respective steps for describing the etching process or the method of manufacturing the color selecting mechanism in Embodiment 3.

With the commencement of the etching of the work 10 from the front surface 10A thereof, the work 10 begins to be etched through the first to third openings 22, 24 and 26 as shown in FIG. 7A. With the progress of the etching, a slit zone 32A is eventually formed in the work 10 under the first opening 22 as a result of etching of the work 10 through the first opening 22.

At the same time, recesses 34A are formed in the work 10 under the second openings 24 as a result of the etching of the work 10 through the second openings 24. Further, an irregular surface area 50A is formed on the work 10 under the third openings 26 as a result of the etching of the work 10 through the third openings 26. The recesses 34A and irregular surface area 50A do not penetrate the work 10. In this stage, the slit zone 32A and the recesses 34A are spaced apart by portions 10C of the work material.

With further progress of the etching of the work 10, the slit zone 32A, recesses 34A and irregular surface area 50A become deeper, and the portions 10C of the work that have been spacing apart the slit zone 32A and recesses 34A turn to be etched. Further, with the etching of the work material 10C or the work 10 in the irregular surface area 50A thereof, the portions of the etching resist layer 20 between the slit zone 32A and recesses 34A, between the recesses 34A and irregular surface area 50A and over the irregular surface area 50A, are ruptured by pressurized etching solution. This rupture of the etching resist layer accelerates the etching of the Work material 10C or work 10 in the irregular surface area 50A thereof.

Figure 7B:
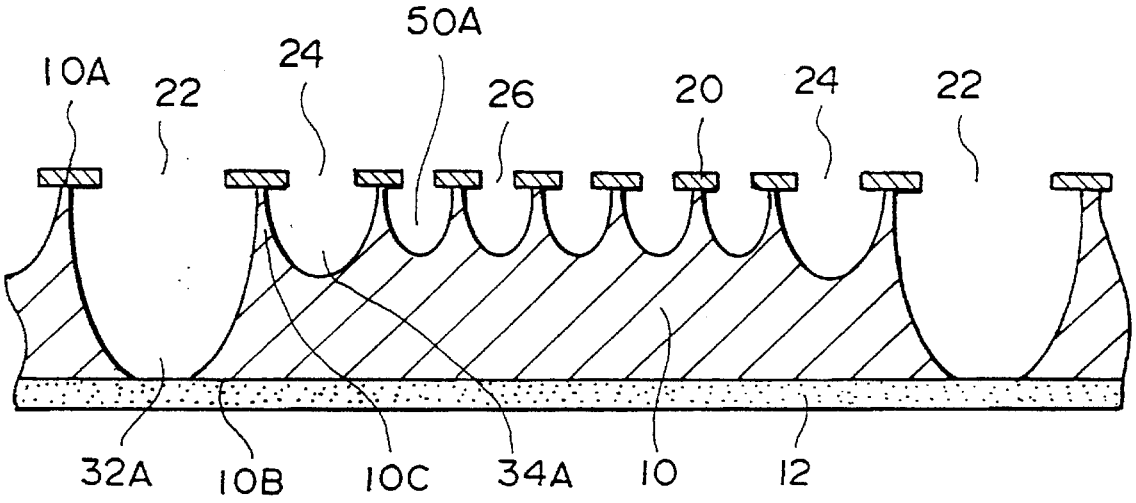

Finally, as shown in FIG. 8A, the slit zone 32 penetrating the work 10 and the recesses 34 on the opposite sides of the slit zone 32 are formed. That is, the slit 30 is formed which comprises the slit zone 32 and the recesses 34. The work material portions 10C that have been spacing apart the slit zone 32 and the recesses 34 as shown in FIG. 7B, have been etched away in the last state of etching as shown in FIG. 8A. The thickness T' of the iron type thin metal sheet in the irregular surface area 50 is smaller than a predetermined thickness $T_0$. In FIG. 8A, the ruptured etching resist layer is shown by broken line.

(Step 330)

After completion of the etching, the etching resist layer 20 remaining on the front surface 10A of the work 10 is separated by using a high temperature aqueous alkali solution, and also the protective layer 12 is separated from the back surface 10B of the work 10 by irradiating the layer 12 with ultraviolet radiation. In this way, a product of etching (i.e., color selecting mechanism) having the structure as shown in FIG. 8B can be obtained.

The thickness T' of the work in the irregular surface area 50 can be controlled by prescribing the number, position and opening area of the third opening or openings 26. By increasing the number of the third openings, the thickness T' of the work in the irregular surface area 50 is generally reduced. Generally, the thickness T' of the work in the irregular surface area 50 can also be reduced by increasing the opening area of the third openings 26. Further, the thickness T' generally can be reduced by reducing the distance between adjacent third openings.

It is possible to provide the recesses 34 for all the slits 30 formed in the product of etching (color selecting mechanism). In this case, second openings 24 are provided on the opposite sides of all the first openings 22 formed in the etching resist layer 20.

Or as described before in connection with Embodiment 1, it is possible to provide recesses 34 on the opposite sides of some of the slits 30 in the product of etching (color selecting mechanism). Further, the slits described before in connection with Embodiments 1 and 2 may coexist. That is, a recess 34 may be provided on the side of each of the slit zones 32 in a portion of the product of etching (color selecting mechanism), and recesses 34 may be provided on the opposite sides of each of the slit zones 32 in other portion of the product of etching (color selecting mechanism).

In the etching process and the method of manufacturing a color selecting mechanism in Embodiment 3, as described before in connection with Embodiment 1, the second openings are formed in portions of the etching resist layer 20 on the opposite sides of the associated first opening when viewed from the center of the work. In addition, the second openings may be formed such that the recesses 34 are progressively greater as one goes away from the center of the work. It is possible to provide a predetermined relation (for instance a relation represented by a first degree function) between the size of the recess 34 and the distance from the center of the product of etching (color selecting mechanism) to the slit 30 or, in the color selecting mechanism, the incidence angle (or deflection angle) of electron beam.

While preferred embodiments of the invention have been described, these embodiments are by no means limitative, and the materials, numerical values and various conditions described in connection with the embodiments are merely exemplary and subject to suitable changes. Further, the etching process according to the invention is applicable not only to the manufacture of color selecting mechanisms but also to any technical field which requires accurate control of the sectional profile of the slit formed in the work and also requires formation of a slit having a greater opening area on one side surface of the work than the opening area on the other side.

In the above embodiments, as the protective layer 12 was used a laminate film comprising a polyester film with adhesive that can be readily removed by irradiation with ultraviolet radiation. Instead, it is possible to form the protective layer 12 by coating the back surface of the work (iron type thin metal sheet) with a material having etching resistance, acid resistance and water resistance, such as lacquers, etching resists, waxes and ultraviolet radiation setting resins.

Further, it is possible to adopt, in lieu of such protective film formation, a belt support system (i.e., a system using a magnetic belt, a film belt, etc. ), a back surface shielding system, etc. By using such a system, it is possible to prevent the etching of the back surface of the work during the etching thereof. In this case, although there is no need of providing any protective layer comprising a laminate film or the like, it is desirable to form an etching resist layer as protective layer on the back surface 10B of the work 10. For example, in a belt support system using a magnetic belt, the work 10 is etched from both the front and back sides with magnetic belt held in close contact with the back surface 10B of the work 10. In this way, the etching resist layer that is formed as protective layer on the back surface 10B of the work 10 is protected by the magnetic belt in close contact with the back surface 10B of the work 10. Thus, it is possible to prevent the etching resist layer formed on the back surface 10B of the work 10 from being ruptured by the etching solution which is pressurized at the time of the etching, thus preventing the etching solution from going round to the back surface 10B of the work 10.

Figure 9A:
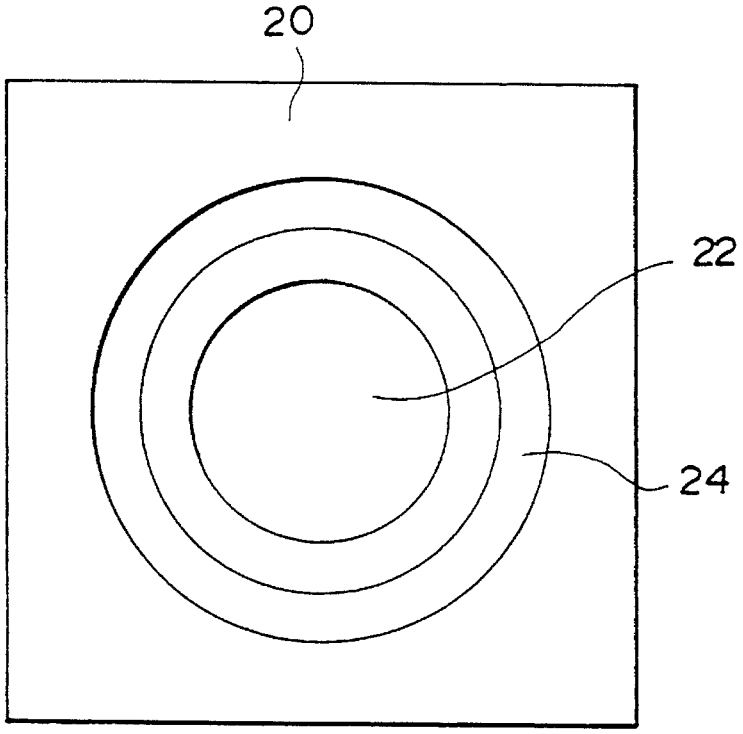
FIGS. 9A and 9B are schematic fragmentary plan views showing a first and a second opening in case when applying the invention to a shadow mask type color selecting mechanism.
Figure 9B:
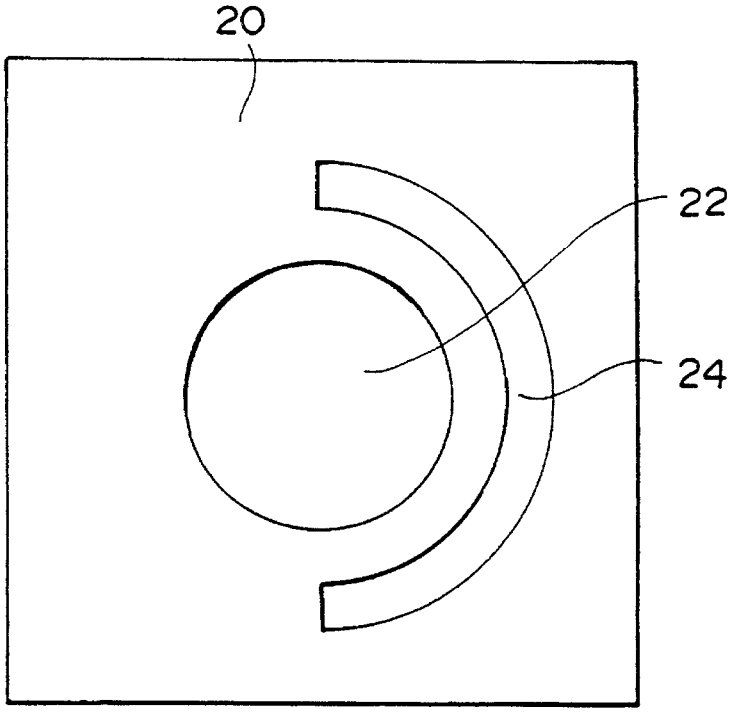
Figure 10:
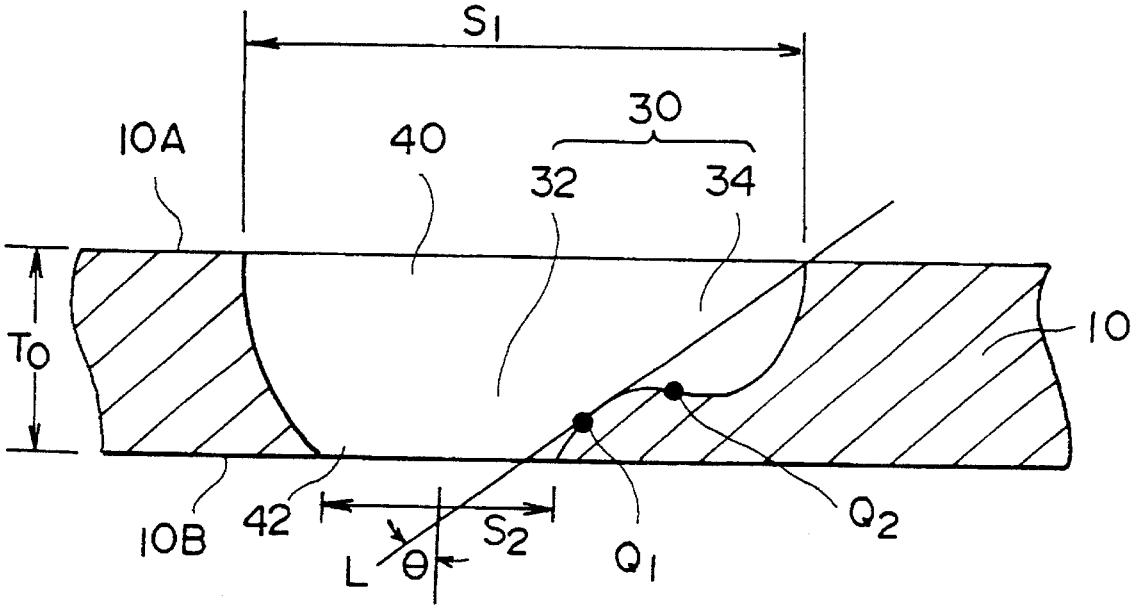
FIG. 10 is a schematic fragmentary sectional view showing a work or a color selecting mechanism having a different sectional profile of slit manufactured by the method of manufacturing a color selecting mechanism according to the invention.
Figure 11:
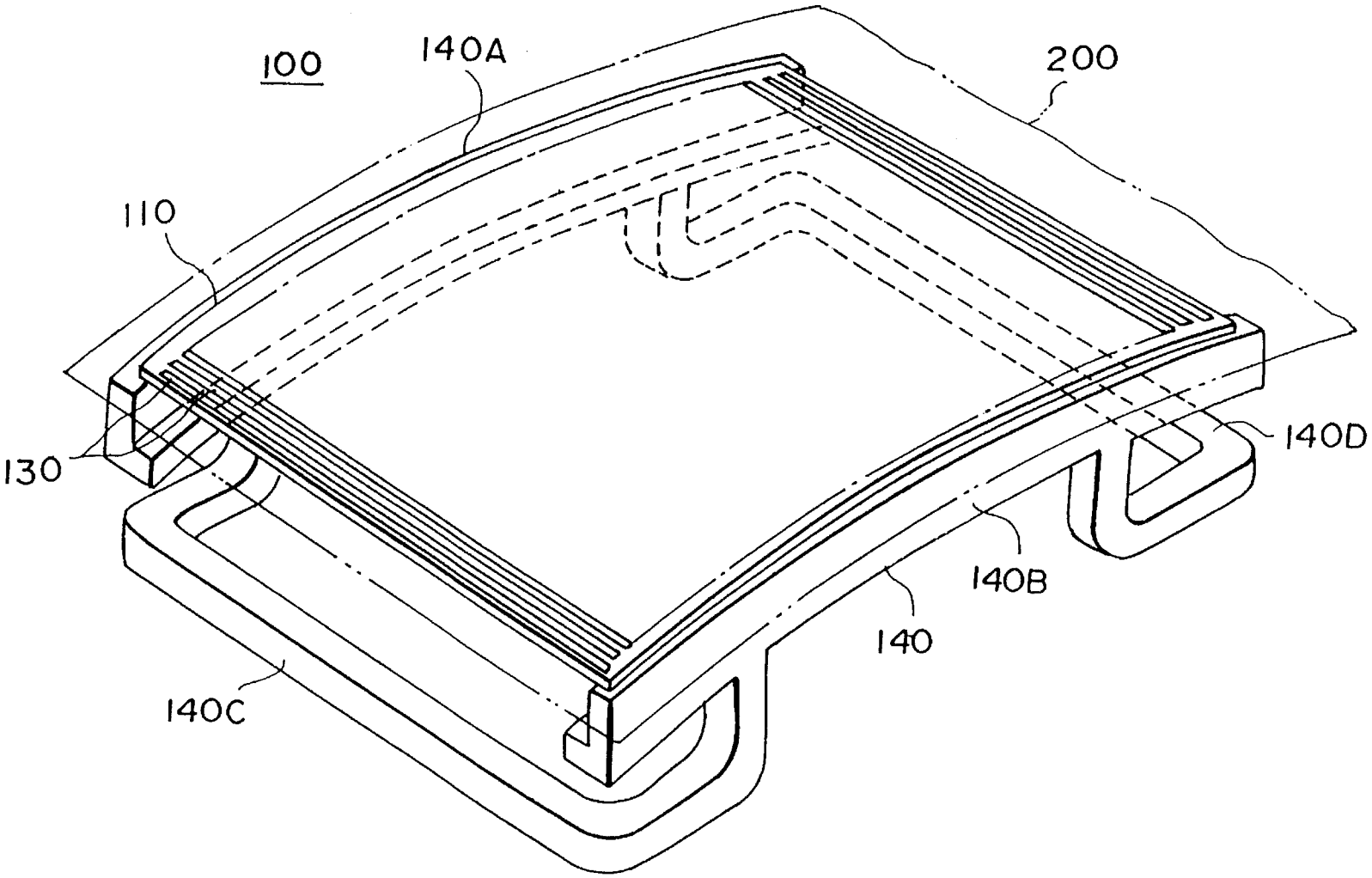
FIG. 11 is a view showing the overall structure of color selecting mechanism.

While the above embodiments concerned with aperture grill type color selecting mechanisms, the invention is also applicable to shadow mask type color selecting mechanisms. FIGS. 9A and 98 are schematic fragmentary plan views showing arrangements of first and second openings 22 and 24 in this case. While FIGS. 9A and 9B each show a single first opening 22 and a single second opening 24, actually large numbers of the first and second openings are formed. In the arrangement of FIG. 9A, second opening 24 has a circular shape surrounding first opening 22. It is thus possible to form a slit having a sectional profile as shown in FIG. 4. In the arrangement of FIG. 9B, second opening 24 partly surrounds first opening 22. It is thus possible to form a slit having a sectional profile as shown in FIG. 1. In FIG. 9A, it is possible to form a third opening (not shown) described in Embodiment 3 concentrically on the outer side of the second opening 24. As a further example, the first opening may be a rectangular opening. In this case, the second opening may have a shape such as to surround part of the rectangle.

In a first mode of the color selecting mechanism according to the invention, the first degree derivative of the curve f(t) has a positive or negative value which may be zero. However, in the etching process or the method of manufacturing a color selecting mechanism according to the invention, there is a case depending on the sizes, arrangement conditions and etching conditions of the first and second openings 22 and 24 that a color selecting mechanism is formed, in which the first degree derivative of the curve f(t) has both positive and negative values. That is, the curve f(t) has an area, in which the sign of the first degree derivative is different from the sign in other area. Even in this case, the curve f(t) has continuity and is smooth. Further, it has inflection points (for instance $Q_1$ and $Q_2$).

As has been described in the foregoing, in the etching process or the method of manufacturing a color selecting mechanism according to the invention, it is possible to form high quality slits with good reproducibility and high stability without need of cumbersome steps, irrespective of the thickness of the work (iron type thin metal sheet) and irrespective of the slit pitch. Besides, the invention is applicable to the manufacture of color selecting mechanisms or the like in a wide scope of specifications without substantial limitations imposed on the thickness of the thin metal sheet used and also on pitch of the slits to be formed. Further, the side walls of the slits may have a smooth curve and a large inclination angle.

Further, according to the invention, with a single-side etching process slits may be formed at a fine pitch in a thin metal sheet having a large thickness, thus permitting manufacture of a color selecting mechanism having a desired quality. As limitations imposed in the technique utilizing an adhesive film described before in connection with FIGS. 15A to 15C, the thickness of the thin metal sheet was 0.10 mm, and the slit pitch was 0.5 mm. Meanwhile, according to the invention it is possible to manufacture products of etching or color selecting mechanisms in wide ranges of the thin metal sheet thickness and the slit pitch.

Further, since it is possible to form slits by the single-side etching process, there is no need of patterning an etching resist layer on the side of the back surface of the work (iron type thin metal sheet). In other words, it is possible to avoid problems in the prior art, in which a pair of photosensitive etching resist masks with respective patterns for the front and back surfaces of the work are used and stringently positioned relative to each other. Besides, because of the single-side etching process, the redundancy (or freedom) of the photosensitive etching resist mask accuracy can be increased. It is thus possible to realize productivity increase and cost reduction.

Further, by using the protective layer formed from a laminate film comprising a polyester film with adhesive which can be readily removed from the work by irradiation with ultraviolet radiation, it is possible to readily realize automation of the inspection of the color selecting mechanism.

Further, the color selecting mechanism according to the invention permits thickness reduction of its entirety. That is, it is possible to manufacture a color selecting mechanism having a desired thickness from an iron type thin metal sheet having a large thickness. Further, it is possible to reduce weight of the color selecting mechanism. Moreover, the slit side walls may have a smoother curve and a greater inclination angle.

What is claimed is:

1. An etching process comprising the steps of:

(a) forming an etching resist layer on the front surface of a work and also forming a protective layer on the back surface of the work;

(b) patterning the etching resist layer to form a first opening in an etching resist layer portion on a slit formation area of the work and a second opening smaller than the first opening in an etching resist layer portion near the first opening; and (c) etching the work to form a slit zone in a work portion under the first opening formed in the etching resist layer and simultaneously a recess in a work portion under the second opening, while removing at least a portion of the work spacing apart the slit zone and the recess;

thereby forming a slit comprising the slit zone and the recess, the slit having an opening area defined on the front surface side of the work by the slit zone and the recess and an opening area defined on the back surface side of the work by the slit zone.

2. The etching process according to claim 1, wherein a portion of the etching resist layer between the first and second openings is ruptured while the work is etched in the thickness direction thereof.

3. The etching process according to claim 1, wherein at least one third opening is formed in a portion of the etching resist layer between adjacent second openings, the thickness of the work under the third opening or openings being controlled during the etching of the work by the number, position and opening area of the third opening or openings.

4. The etching process according to claim 1, wherein the first and second openings formed in the etching resist layer are parallel to each other and have a slit shape, and the second opening is formed in a portion of the etching resist layer on the outer side of the first opening when viewed from the center of the work.

5. The etching process according to claim 1, wherein the second opening is formed in a portion of the etching resist layer on the outer side of the first opening when viewed from the center of the work, and the second opening is formed such that the recess is greater in size as one goes away from the center of the work.

6. A method of manufacturing a color selecting mechanism, in which electron beams pass through a thin metal sheet, comprising the steps of:

forming an etching resist layer on the front surface of the thin metal sheet and also forming a protective layer on the back surface of the thin metal sheet;

patterning the etching resist layer to form a first opening in a portion of the etching resist layer on a slit formation area of the thin metal sheet and a second opening smaller than the first opening in a portion of the etching resist layer near the first opening; and etching the thin metal sheet to form a slit zone in a portion of the thin metal sheet under the first opening formed in the etching resist layer and simultaneously a recess in a portion of the thin metal sheet under the second opening, while removing at least a portion of the etching resist layer spacing apart the slit zone and the recess;

thereby forming a slit comprising the slit zone and the recess, the slit having an opening area defined on the front surface side of the thin metal sheet by the slit zone and the recess and also an opening area defined on the back surface side of the thin metal sheet by the slit zone.

7. A color selecting mechanism comprising a thin metal sheet formed with a plurality of electron beam passage slits, the opening area of each of the slits in the color selecting mechanism on the electron beam incidence side thereof being smaller in size than the opening area of the slit on the electron beam emission side, at least a slit side wall portion being represented by a curve f(t) where t is the thickness of the thin metal sheet in the section of the slit in the thickness direction of the thin metal sheet, a first degree derivative of the curve f(t) having a positive or negative value or zero in the entire range of t, the curve f(t) having one or more inflection points.

8. A color selecting mechanism having a plurality of electron beam passage slits formed by etching an iron type thin metal sheet having a first thickness, the opening area of each of the slits in the color selecting mechanism on the electron beam incidence side being smaller in size than the opening area of the slit on the electron beam emission side, the electron beam emission side surface of the iron type thin metal sheet between adjacent slits being formed with an irregular surface area, the thickness of the iron type thin metal sheet in the irregular surface area being smaller than the first thickness.

9. The color selecting mechanism according to claim 7, wherein the slits are of a stripe shape.

10. The color selecting mechanism according to claim 7, wherein the slits are circular in shape.

* * * * *